United States Patent [19]

Schlienger

[11] Patent Number: 4,861,001

[45] Date of Patent: Aug. 29, 1989

[54] MELTING RETORT AND METHOD OF MELTING MATERIALS

[75] Inventor: Max P. Schlienger, Ukiah, Calif.

[73] Assignee: Retech, Inc., Ukiah, Calif.

[21] Appl. No.: 76,102

[22] Filed: Jul. 21, 1987

[51] Int. Cl.[4] ..... C22B 7/00

[52] U.S. Cl. ..... 266/242; 75/10.13; 75/10.34; 110/250

[58] Field of Search ..... 266/242, 244, 236; 75/10.34, 10.53, 10.13; 373/16, 18, 22, 10; 110/250, 8, 346

[56] References Cited

U.S. PATENT DOCUMENTS

| | | | |
|---|---|---|---|
| 1,724,352 | 8/1929 | Ilving | 110/250 |
| 2,402,436 | 6/1946 | Nichols | 110/250 |
| 2,505,363 | 4/1950 | Nichols | 110/250 |
| 2,694,097 | 11/1954 | Collin | 75/10.34 |
| 2,957,936 | 10/1960 | Bugge | 266/236 |
| 2,982,534 | 5/1961 | Meffert | 266/236 |
| 3,150,961 | 9/1964 | Collin | 75/10.34 |
| 3,599,581 | 8/1971 | Schoppe | 110/8 |
| 3,680,503 | 8/1972 | Danielsson et al. | 110/250 |
| 3,779,182 | 12/1973 | Camacho | 110/8 |
| 3,918,374 | 11/1975 | Yamamoto et al. | 110/250 |
| 4,137,051 | 1/1979 | Godwin | 110/250 |
| 4,181,504 | 1/1980 | Camacho | 48/197 |
| 4,388,876 | 6/1983 | Burton | 110/250 |
| 4,417,529 | 11/1983 | Fujimoto | 110/250 |
| 4,437,452 | 3/1984 | Reschly | 110/250 |
| 4,545,306 | 10/1985 | Wolfram | 110/250 |
| 4,582,004 | 4/1986 | Fey et al. | 110/346 |
| 4,615,285 | 10/1986 | Bentell et al. | 110/346 |

FOREIGN PATENT DOCUMENTS

| | | |
|---|---|---|
| 1170548 | 11/1969 | United Kingdom . |
| 2018812 | 10/1979 | United Kingdom . |
| 2152949 | 8/1985 | United Kingdom . |

*Primary Examiner*—S. Kastler

*Attorney, Agent, or Firm*—Townsend and Townsend

[57] ABSTRACT

An improved melting retort and method of melting materials wherein the retort allows for easier material feeding capability with a wider range of types of materials while minimizing the movement of any unmelted materials to the pouring lip of the retort. The retort is mounted for rotation on either a bearing or rollers to enable feed materials directed into the retort from one peripheral location to be advanced into one or more several melt areas by rotating the retort about its central axis. In each of the melting areas, a heat source, such as an electron beam gun or plasma torch, is provided above the open top of the retort and melts the materials therebelow. In one embodiment, the molten material is poured from an inner peripheral portion thereof and gravitates through a central hole of the retort and into a secondary crucible or mold. In this geometry, the melted material can be fed into the secondary crucible in a continuous manner. In another embodiment, the pouring lip of the retort is at an outer peripheral portion for gravitation of the molten materials into a secondary crucible near the outer periphery of the retort. In either embodiment, the secondary crucible is provided with a heat source thereabove to shape the molten materials in the crucible.

16 Claims, 3 Drawing Sheets

MELTING RETORT AND METHOD OF MELTING MATERIALS

This invention relates to improvements in the melting of metals and other materials and, more particularly, to a melting retort and to a method of melting materials.

BACKGROUND OF THE INVENTION

Over the past several years, a number of different improvements have been mandated for the producers of high performance metals, such as metals used in critical aerospace, nuclear and other high-tech areas requiring high reliability requirements for the metals. For instance, in the melting of titanium or nickel-based materials where a high degree of cleanliness is required to enable the maximum in finished product integrity and dependability, the trend is toward the melting of materials in a trough-like retort which overflows into a secondary crucible for the production of an ingot or other metallurgical product. Such a product may consist of a shaped casting or may be further processed into a powder.

To date, the hearth or primary melting retort of conventional construction is primarily linear in shape and has a length in the range typically of 0.5 to 1.5 meters, depending upon the power and metallurgical requirements. By having a relatively long, shallow hearth or retort, metals can be melted in a longitudinal stream, allowing for sufficient time at a superheat temperature to allow removal of both high density and low density inclusions before being transferred to the secondary crucible or receptacle where the finished product is formed by secondary melting and shaping.

One of the problems associated with this type of hearth or retort relates to the feeding of loose raw materials and scrap into the retort. In hearth melting, a non-consumable heat source is normally used, such as an electron beam gun, plasma torch or a Rototrode. However, in all cases, it is necessary for the heat source to be in close proximity to the material feeder to enable melting the materials and advancing the materials along the length of the retort. This is achieved by maintaining a linear molten stream. This geometry limits not only the type of feed stock but also the design and manipulation of the feeder itself. The reasons for this is the proximity of the high energy melting arc or beam and the mechanical interference with the material feed means of the actual melting or heating source.

Because of these problems associated with conventional melting retorts, improvements are needed to avoid such problems. The present invention satisfies this need. Prior disclosures in this field include U.S. Pat. Nos. 2.982,534 and 3,150,961.

SUMMARY OF THE INVENTION

The present invention is directed to an improved melting retort and method of melting materials wherein the retort allows for easier material feeding capability with a wider range of types of materials while minimizing the movement of any unmelted materials to the pouring lip of the retort. This is achieved by providing a retort which is mounted for rotation on either a bearing or rollers to enable feed materials directed into the retort from one peripheral location to be advanced into one or more several melt areas by rotating the retort about its central axis. In each of the melting areas, a heat source, such as an electron beam gun or plasma torch is provided above the open top of the retort and melts the materials therebelow.

In one embodiment of the invention, the molten material is poured from an inner peripheral portion thereof and gravitates through a central hole of the retort and into a secondary crucible or mold. In this geometry, the melted material can be fed into the secondary crucible in a continuous manner.

In another embodiment of the retort of the present invention, the pouring lip of the retort could be at an outer peripheral portion for gravitation of the molten materials into a secondary crucible near the outer periphery of the retort. In either embodiment, the secondary crucible is provided with a heat source thereabove to shape the molten materials in the crucible.

It is to be emphasized that the retort of the present invention can be configured with a number of different flow configurations to increase residence time or length of melt stream. Dams or baffles could be used when machining the retort to enable specific process requirements to be carried out.

The primary object of the present invention is to provide an improved melting retort and method of melting materials wherein the retort is mounted for rotation about a central axis so that incoming materials to be melted can be directed into the retort at one location and the retort then be rotated about its central axis through a predetermined arc to position the materials in proximity to one or more high temperature heat sources, whereby the materials can be quickly melted and caused to continuously leave the retort for gravitation into a secondary crucible located near an inner or outer periphery of the retort.

Other objects of this invention will become apparent as the following specification progresses, reference being had to the accompanying drawings for an illustration of several embodiments of the invention.

IN THE DRAWINGS

Figure 1:
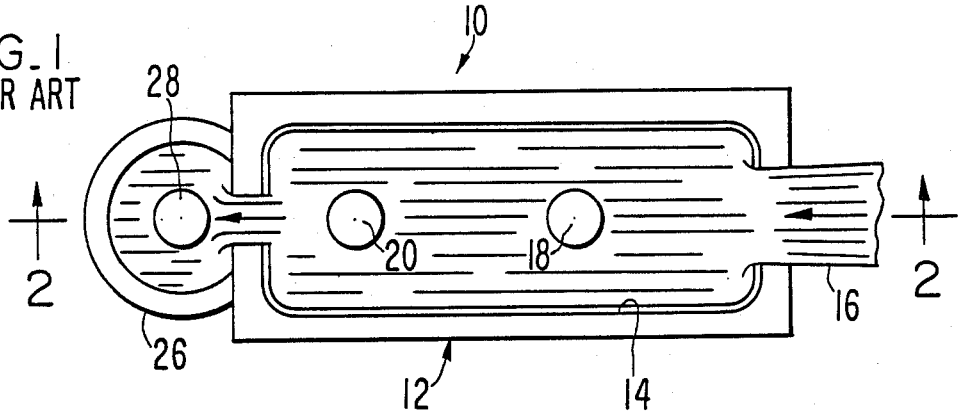
FIG. 1 PRIOR ART
FIG. 1 is a top plan view of a open top, trough-shaped retort of the prior art, showing the material feed at one end thereof and the secondary crucible at the opposite end thereof.
Figure 2:
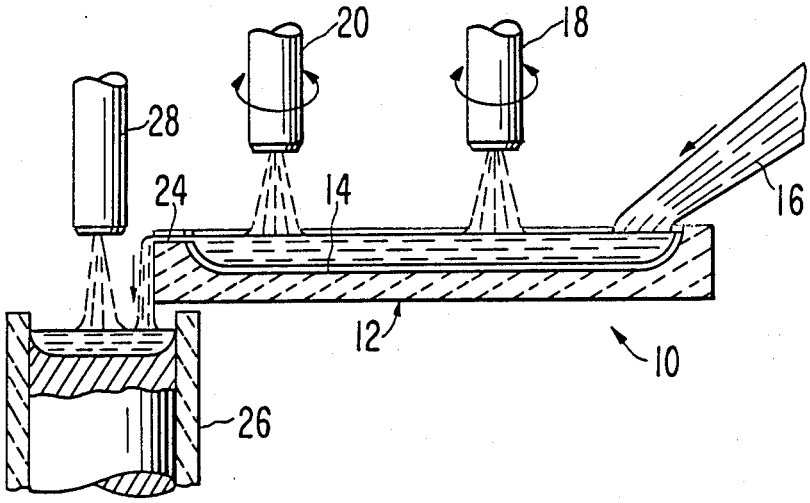
FIG. 2 PRIOR ART
FIG. 2 is a vertical section through the prior art retort of FIG. 1.

FIGS. 1 and 2 show views of a prior art retort broadly denoted by the numeral 10 which includes a hearth body 12 typically of copper and water cooled. The hearth has a predetermined length, such as 0.5 to 1.5 meters. Hearth body 12 has a trough-like recess 14 which is shallow as shown in FIG. 2 for the melting of loose raw materials and scraps fed into one end of recess 14 through a feed tube 16. The metals are heated by high temperature heat sources 18 and 20 which can be electron beam guns, plasma torches or the like. As shown in FIG. 2, plasma torches are used to heat the materials in recess 14, the plasma stream 22 of each torch 18 and 20 being directed downwardly with the torches being in close proximity to the materials in recess 14 of retort body 12.

The retort body 12 has a dam or weir 24 at the downstream end thereof. The molten material flows over the dam and into a secondary, liquid cooled crucible 26. A third high temperature heat source 28 is above the crucible to heat the molten materials therein.

The main drawback of the use of the prior art crucible of FIGS. 1 and 2 is the fact that heat sources 18 and 20 must be in close proximity to the materials to melt the materials and assure that the molten materials are moved in a stream along the length of the hearth. To avoid this problem, the present invention provides a rotatable retort which allows loose raw materials and scrap to be directed into the open top of the retort near one outer peripheral portion thereof and then the retort is rotated so the materials are located beneath high temperature heat sources, such as electron beam guns, plasma torches or the like.

Figure 3:
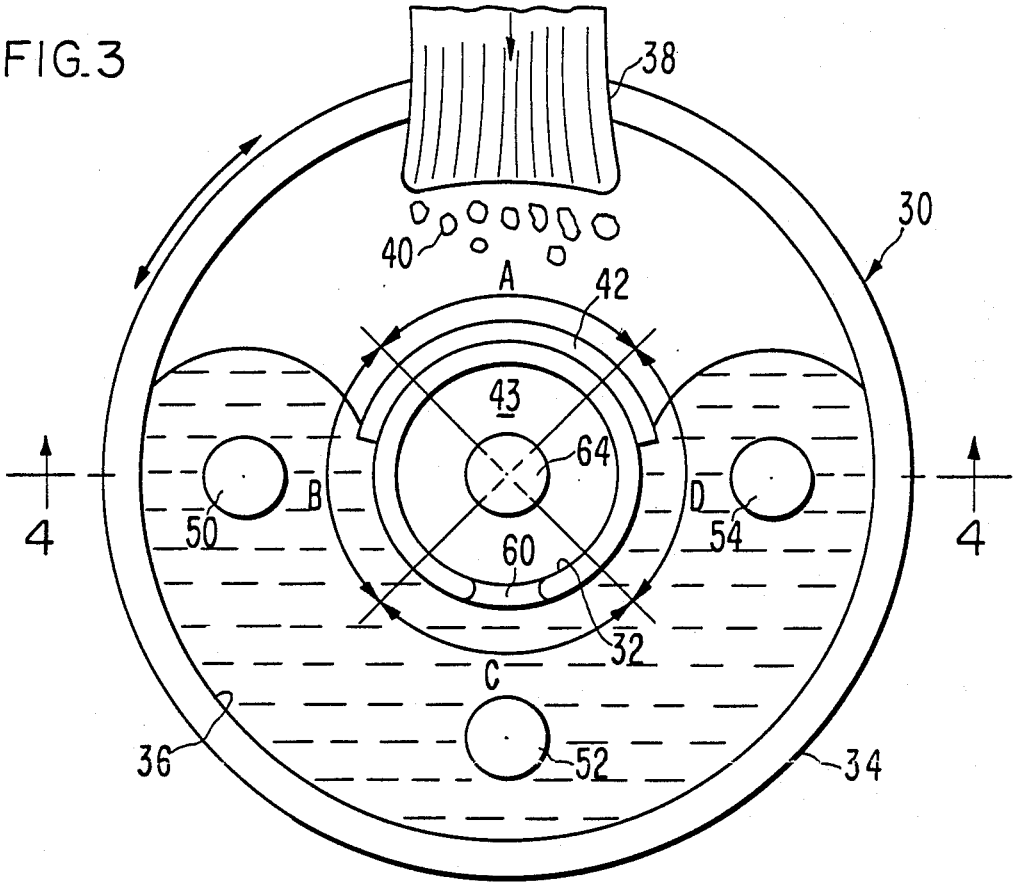
FIG. 3 is a top plan view of a first embodiment of the retort of the present invention.
Figure 4:
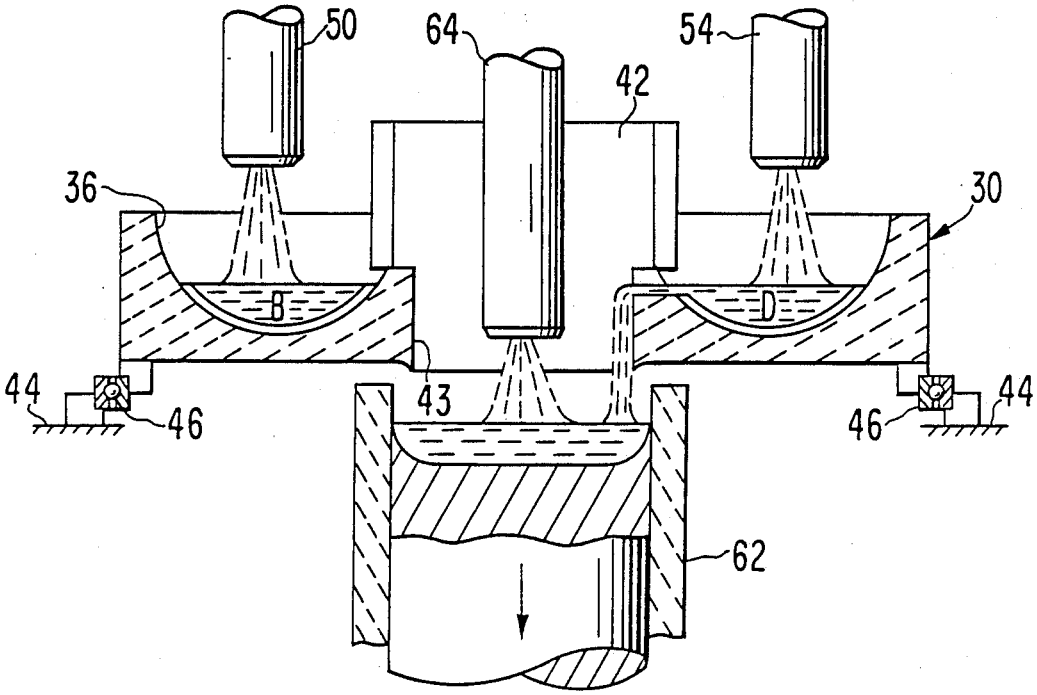
FIG. 4 is a vertical section taken along line 4—4 of FIG. 3.

A first embodiment of the retort of the present invention is broadly denoted by the numeral 30 and is shown in FIGS. 3 and 4. Retort 30 is ring shaped in plan form in that it has an inner periphery 32, and an outer periphery 34, and a hollowed out, open top recess 36 between the inner and outer peripheries. A material feed tube 38 is provided in some fixed location near the outer periphery 34 of retort 30. Tube 38 directs loose raw materials and scrap, denoted by the numeral 40 into recess 36. A material feed barrier 42 is located in partially surrounding relationship to the inner periphery 32 of the retort to prevent loose raw materials and scrap from falling into the central hole 43 of the retort body. The barrier is secured at its lower end face (FIG. 4) on the retort body in some suitable manner.

Retort 30 is rotatably mounted by bearing means 46 on a fixed support 44. The retort typically is rotatable through an angle of 180° to 270°. For purposes of illustration, the retort will be rotatable through 270° so that the feed materials can be placed beneath high temperature heat sources 50, 52 and 54 located above zones B, C and D of recess 36 of retort 30, assuming that feed materials are fed into a zone A as shown in FIG. 3. By allowing the retort to rotate about its central axis, the feed materials can be readily placed in close proximity to the heat sources 50, 52 and 54 as shown in FIG. 4. The heat sources, even though they are in close proximity to the retort, do not interfere with the incoming materials as they leave the tube 38 and enter the retort since the materials will distribute themselves out in the recess 36 of the retort before the materials are rotated with the retort to zones B, C and D.

Retort 30 has a pouring lip 60 as shown in FIG. 3 over which the molten materials from the retort fall into the central hole 43 of the retort and gravitate into a secondary crucible 62 (FIG. 4) situated below the central hole and of a diameter greater than the hole. The crucible 62 is typically water cooled and sufficiently close to the underside of the retort 30 to be sure to catch all molten materials overflowing lip 60. Also, a heat source 64, such as a plasma torch, is located above crucible 62 and within hole 43 so that the melted materials from the retort can be fed into the secondary crucible in a continuous manner. The rotation of the retort is limited to 180° to 270° to eliminate the requirement for a complex vacuum tight water cooling joint. Since the retort is liquid cooled, the introduction of cooling liquid will most likely not be on the central axis of the retort.

In operation, with the retort arranged in the manner shown in FIGS. 3 and 4, materials are fed into the A zone from tube 38. The materials can then be advanced away from tube 38 by rotating the retort until the materials are at the B C and D zones where the materials are melted by heat sources, such as plasma torches or electron beam guns. These heat sources have the capability of providing melting heat in the B, C and D zones. In the A zone, barrier 42 is liquid cooled and is used to prevent any unmelted material from being fed into the secondary crucible 62.

Figure 5:
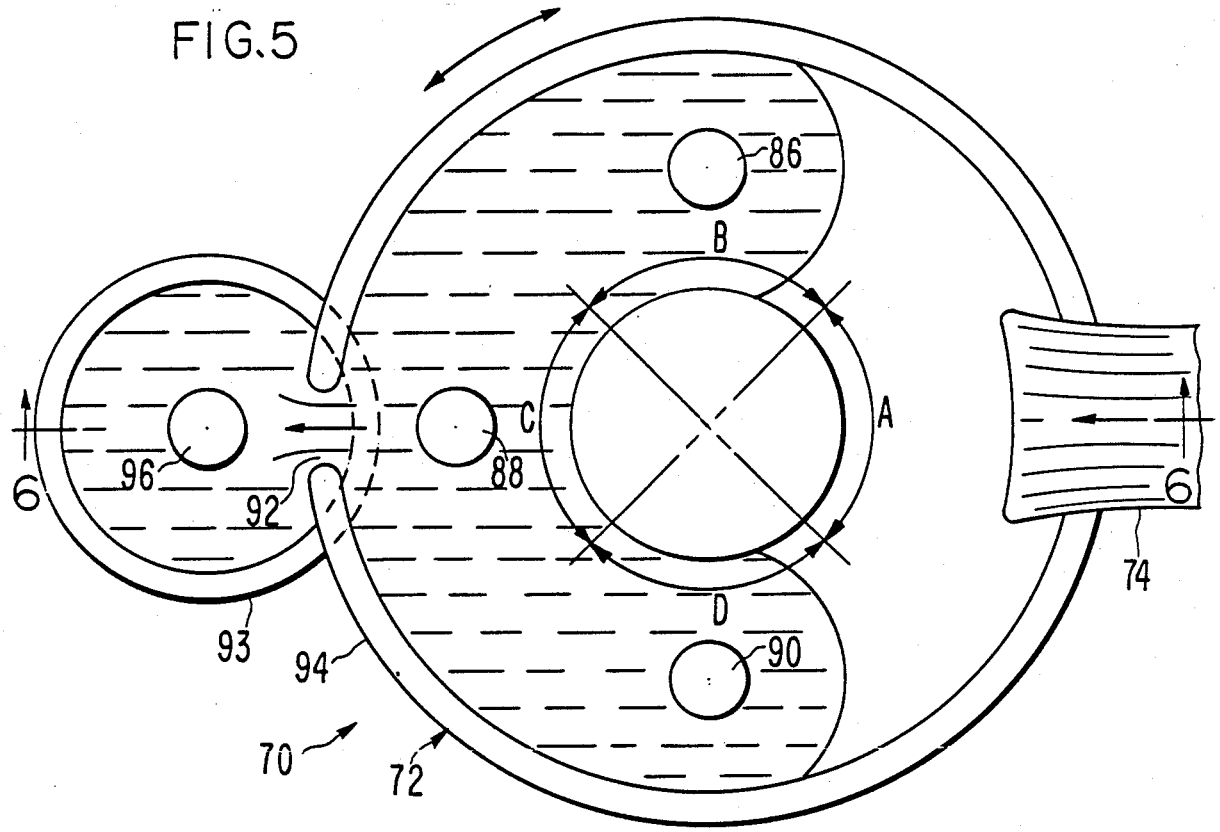
FIG. 5 is a view similar to FIG. 3 but showing another embodiment of the retort of the present invention.
Figure 6:
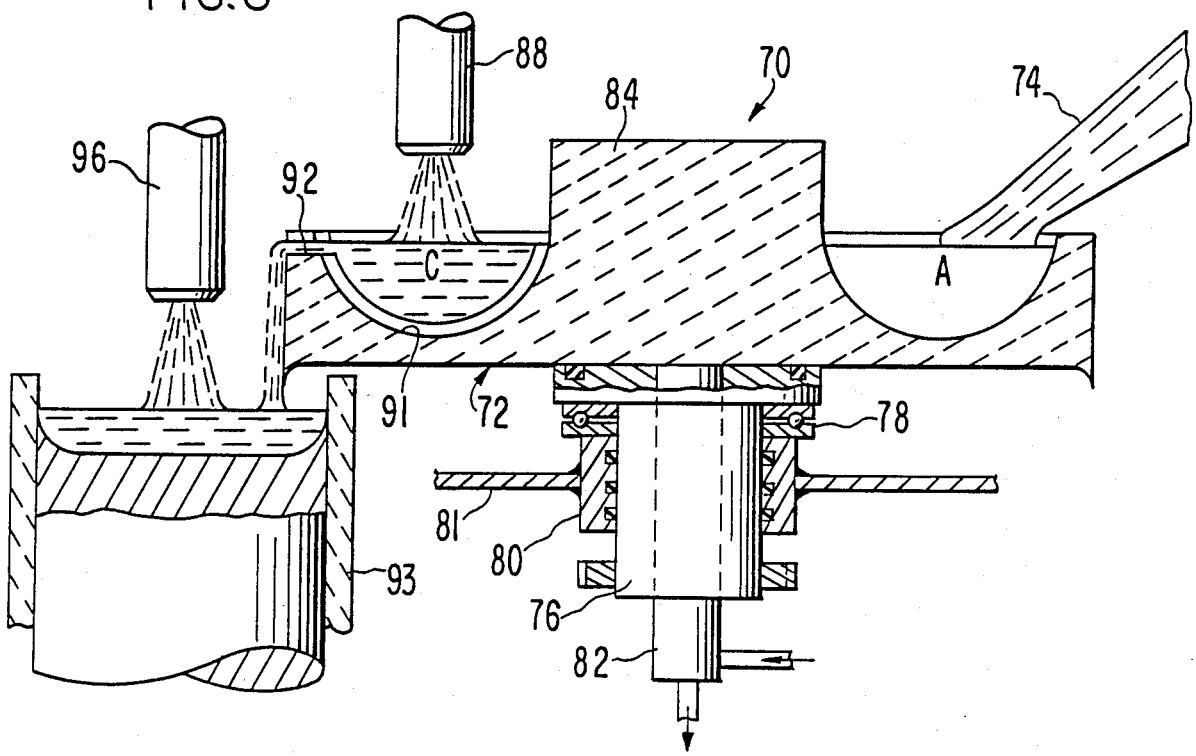
FIG. 6 is a vertical section taken along line 6—6 of FIG. 5.

FIGS. 5 and 6 show a second embodiment of the retort of the present invention, the retort being broadly denoted by the numeral 70 and including a retort body 72 having a feed tube 74 for directing materials into an A zone of the retort. The retort is mounted on a central shaft 76 for rotation by means of a bearing 78 about a vertical axis. A rotary seal 80 is provided beneath the bearing 78 extending through a furnace housing part 80 so that a rotary water joint 82 can direct coolant into and through shaft 76 and through retort 70 for cooling the retort. The central part 84 of the retort is solid metal. By rotating the retort, materials fed into the A zone can be directed into zones B, C and D (FIG. 5).

Heat sources 86, 88 and 90 are provided to melt the materials in zones B, C and D. The heat sources can be electron beam guns, plasma torches or the like. They can be placed in close proximity to the circular recess 91 of the retort as shown in FIG. 6 so that they can be in sufficiently close proximity to the materials to effectively heat the same at minimum power expenditure.

A secondary crucible 93 is located near the outer periphery of the retort at a location diametrically opposed to materials feed tube 74 as shown in FIG. 5. A lip 92 in the outer periphery 94 of the retort allows molten materials to flow out of the retort and into the secondary crucible 93, above which is a heat source 96, such as an electron beam gun or a plasma torch. The heat source 96 further heats the molten material in the secondary crucible so that the molten material will conform to the inner surface of the crucible itself.

Providing the pour lip 92 on the outer diameter of the retort allows for more flexibility for pouring molten materials into secondary crucible 93 which can have a shape other than round. This feature also dictates a longer flow path for molten materials.

The retort 70 has a closed center and cooling liquids can be supplied by rotary liquid joint 82 outside the furnace housing which would enable continuous rotation of the retort in either direction, if desired. In a continuous rotation mode, materials flow from the pour lip would cease when the lip was not properly placed over the secondary crucible 93. Such interuptions is easily obtained with the retort by simply removing melting heat form the lip area.

What I claim is:

1. Apparatus for melting raw materials comprising:

a retort having an open top recess;

means mounting the retort for rotational movement relative to a fixed reference;

means adjacent to one location of the retort for feeding raw materials into the recess of the retort;

a heat source above and aligned with the recess of the retort at a second location spaced from the first location and in a position to direct heat energy into the open top of the recess of the retort, said retort being rotatable to move the materials directed into the recess at said one location to a position beneath the heat source at said second location, whereby the heat source will be aligned with and will melt the materials, said retort having an exit zone for allowing molten raw materials to flow out of the retort, said retort having an inner periphery defining a central hole and a lip at said exit zone adjacent to the inner periphery, said molten materials melted in the retort being movable out of the retort over the lip and out of the retort through the central hole thereof, there being a secondary crucible aligned with the central hole and adapted to receive the molten materials flowing over the lip; and a heat source above the secondary crucible and aligned with the central hole for heating the molten material directed into the crucible from the retort.

2. Apparatus as set forth in claim 1, wherein said retort has an outer periphery and said mounting means comprises a bearing structure coupled to the retort near the outer periphery thereof.

3. Apparatus as set forth in claim 1, wherein said mounting means permits the retort to rotate about a generally vertical axis through an angle in the range of 180 degrees to 270 degrees.

4. Apparatus as set forth in claim 1, wherein is included a number of circumferentially spaced heat sources, said heat sources being oriented to direct heat energy downwardly and into the open top recess of the retort at circumferentially spaced zones adjacent to the retort for heating the materials in the retort.

5. Apparatus as set forth in claim 1, wherein said material feed means comprises a tube located near the outer periphery of the retort at the first zone below the lower end of said heat source.

6. Apparatus as set forth in claim 1, wherein said retort is adapted recess for directly receiving the materials, said retort being rotatable from a first location at which the materials are adjacent to the feed tube to another position at which the materials are at locations circumferentially spaced from each other, there being a heat source at each location respectively.

7. Apparatus as set forth in claim 6, wherein said heat sources are electron beam guns.

8. Apparatus as set forth in claim 6, wherein said heat sources are plasma torches.

9. Apparatus as set forth in claim 1, wherein said feed means includes a feed tube near the outer periphery of the retort, said retort having an inner periphery, there being a material barrier adjacent to the inner periphery of the retort for preventing raw materials entering the retort to flow radially inwardly beyond a certain location.

10. Apparatus as set forth in claim 1, wherein said retort has means for directing a coolant therethrough for cooling the retort.

11. Apparatus for melting raw materials comprising: a retort having an open top; means mounting the retort for movement relative to a fixed reference; means adjacent to one location of the retort for feeding raw materials into the retort; a heat source above the retort at a second location spaced from the first location and in a position to direct heat energy into the open top of the retort, said retort being shiftable to move the materials directed thereinto at said one location to a position beneath the heat source at said second location, whereby the heat source will be aligned with and melt the materials, said retort having an outer peripheral lip defining an exit zone past which molten raw materials are directed for flow out of the retort, there being a secondary crucible below the lip and aligned therewith to receive molten materials therefrom, and a heat source above the secondary crucible for heating the molten materials received therein.

12. A method of melting raw materials comprising:

directing the materials into a first zone;

moving the materials along a circular path into a second zone spaced from the first zone;

applying heat to the raw materials in the second zone from above the path to melt the materials;

allowing the molten materials to flow out of the second zone;

collecting the molten materials in a third zone; and heating the molten material collected in the third zone.

13. A method as set forth in claim 12, wherein said moving step includes rotating the materials at said first zone to the second zone.

14. A method as set forth in claim 12, wherein is included the step of moving the materials along a circular path from the first zone through an angle of 180 degrees to 270 degrees to a number of second zones, said heat applying step includes simultaneously melting the materials at said second zones from above the path.

15. A method as set forth in claim 14, wherein said allowing step includes permitting the molten materials to flow through a central hole surrounded by said zones.

16. A method as set forth in claim 14, wherein is included the step of allowing the molten materials to flow out of one of the zones near the outer periphery thereof.

* * * * *